US005954627A

United States Patent [19]

Sekine et al.

[11] Patent Number: 5,954,627

[45] Date of Patent: Sep. 21, 1999

[54] ACCESS PORT FOR USE IN MEDICAL VESSEL

[75] Inventors: Misao Sekine, Noda; Shinichi Kobayashi, Tokyo; Naoki Honma, Urawa; Kazuo Matsubara, Tokyo, all of Japan

[73] Assignee: Atom Medical Corporation, Japan

[21] Appl. No.: 08/730,224

[22] Filed: Oct. 15, 1996

[51] Int. Cl.[6] ..... A61G 11/00

[52] U.S. Cl. ..... 600/22; 600/21

[58] Field of Search ..... 600/21, 22; 220/334, 220/360, 367.1

[56] References Cited

U.S. PATENT DOCUMENTS 2,720,387 10/1955 Dorsak ..... 600/22
5,112,293 5/1992 Vaccaro ..... 600/22

*Primary Examiner*—Linda C. M. Dvorak
*Assistant Examiner*—Rosiland Kearney
*Attorney, Agent, or Firm*—Rudnick & Wolfe

[57] ABSTRACT

An access port for use in a medical vessel comprises an inner frame (15) detachably mounted on an opening of a transparent hood (13) of the infant incubator. An outer frame (16) is slidably engaged to said inner frame (15). A flexible sheet (14) has one end connected to said inner frame (15) and another end connected to said outer frame (16). It is characterized in that a stopper (36) is carried by said outer frame (16).

Another access port for use in a medical vessel comprising: a frame (52) having an opening (56); a horseshoe plate (58) pivotally supported on the frame (52) to open or close said opening (56); a lock mechanism (78) for locking said horseshoe plate (58) in situ which is closed; an inner side (66) provided on the horseshoe plate (58); a plurality of resilient pieces (72) mounted to said horseshoe plate (58) to close said inner side (66); and a holding means (74) provided on the horseshoe plate (58) to hold a member inserted through said plurality of resilient pieces (72).

3 Claims, 7 Drawing Sheets

ACCESS PORT FOR USE IN MEDICAL VESSEL

The present invention relates to an access port for use in a medical vessel such as an infant incubator which receives a premature baby.

BACKGROUND OF THE INVENTION

In a conventional infant incubator as shown in FIG. 1, an access port 11 is used to nurse a premature baby 12 so that a nurse's hand (not shown) is accessed in the space partitioned by a transparent plate or hood 13. This access port 11 comprises a tubular flexible sheet 14 folded at about half portion in length, an inner frame 15 mounted to the hood 13 and receiving at its inner rim of the flexible sheet 14, and a rotatable outer frame 16 concentrically movably disposed on the inner frame 15 and receiving at its outer rim of the flexible sheet 14 to adjust the opening degree of the access port 11 by squeezing the flexible sheet 14 by the rotation of the outer frame 16.

In the access port 11, the closed sheet 14 can support a medical tube 17 to be inserted. For example, after an artificial respiration tube 17 or cables (not shown) of an electrocardiogram are attached to a mouth or other body portions of the premature baby 12 in the infant incubator 10 through the access port 11 and the access port 11 is then closed, the inner space of the infant incubator 10 is substantially isolated from the outer space or atmosphere. Then, the desirable medical treatment is performed without disturbing the inner space of the infant incubator.

This access port 11 is so assembled that the outer frame 16 is easily rotated on the inner frame 15 to easily and rapidly access the premature baby 12 mentioned the above.

However, the easy and rapid access through the access port 11 causes the temperature or humidity control in the inner space to be more difficult since it is difficult to retain the outer frame 16 at an arbitrary position against the inner frame 15. Therefore, the access port 11 is apt to be opened by the self-weight or movement of the respiration tube 17 or cable even if the flexible sheet 14 is squeezed to be completely closed when the respiration tube 17 is inserted into the infant incubator 10 through the access port 11.

For example, when the medical treatment or monitoring of the premature baby 12 in the infant incubator is performed, the respiration tube 17 or cables are attached to the premature baby 12 through the access port 11. The access port 11 is closed to isolate the inner space from the ambience after the respiration tube 17 or cables are attached. However, the flexible sheet 14 of the access port 11 must be able to support the weight of mainly the respiration tube 17 and outer force due to the movement or offset of the respiration tube 17 or cables which is generated by the movement of the premature baby 12, or uncarefullnesss of the nurse or doctor walked around the infant incubator. When the outer force is applied to the flexible sheet 14 of the access port 11, the outer frame 16 is rotated to open the flexible sheet 14 of the access port 11. Then, it is necessary to frequently confirm or monitor the condition of the access port 11 and then adjust the access port 11 to be closed as necessary. If this adjustment to the access port 11 is not frequently performed, the access port 11 is apt to be gradually opened to leak the controlled air in the infant incubator to an unpermitable level.

BRIEF SUMMARY OF INVENTION

It is an object of the present invention to provide an access port which firmly retains its outer frame against its inner frame while the outer frame is easily moved on the inner frame.

It is another object of the present invention to provide an access port by which members such as a respiration tube or cables can be firmly supported.

According to the present invention, an access port for use in medical vessel comprises: an inner frame 15 detachably mounted on an opening of a transparent hood 13 of the infant incubator; an outer frame 16 slidably engaged with said inner frame 15; and a flexible sheet 14 having one end connected to said inner frame 15 and another end connected to said outer frame 16, and characterized by a stopper 36 carried by said outer frame 16.

The stopper may be pivotally supported on said outer frame (16) and has a lever configuration whose top portion abuts to said inner frame (15).

The outer frame (16) preferably has a knob to rotate said outer frame (16) and said stopper includes a lever pivotally supported on said knob.

It is also preferable that said outer frame (16) has a ring configuration, said inner frame (15) has a cylindrical portion slidably engaged on said outer frame (16), said stopper (36) includes a first corner contacted and then pressed to the cylindrical portion upon pivoting, and a second corner pressed to the cylindrical portion as well as said first corner.

According to another aspect of the present invention, an access port for use in a medical vessel comprising: a frame having an opening; a horseshoe plate pivotally supported on the frame to open or close said opening; a lock mechanism for locking said horseshoe plate in situ which is closed; an inner side provided on the horseshoe plate; a plurality of resilient pieces mounted to said horseshoe plate to close said inner side; and a holding means provided on the horseshoe plate to hold a member inserted through said plurality of resilient pieces.

BRIEF DESCRIPTION OF DRAWINGS

The foregoing and other objects, features and advantages of the invention will become more apparent upon a reading of the following detailed description and drawing, in which.

DETAILED DESCRIPTION

Figure 2:
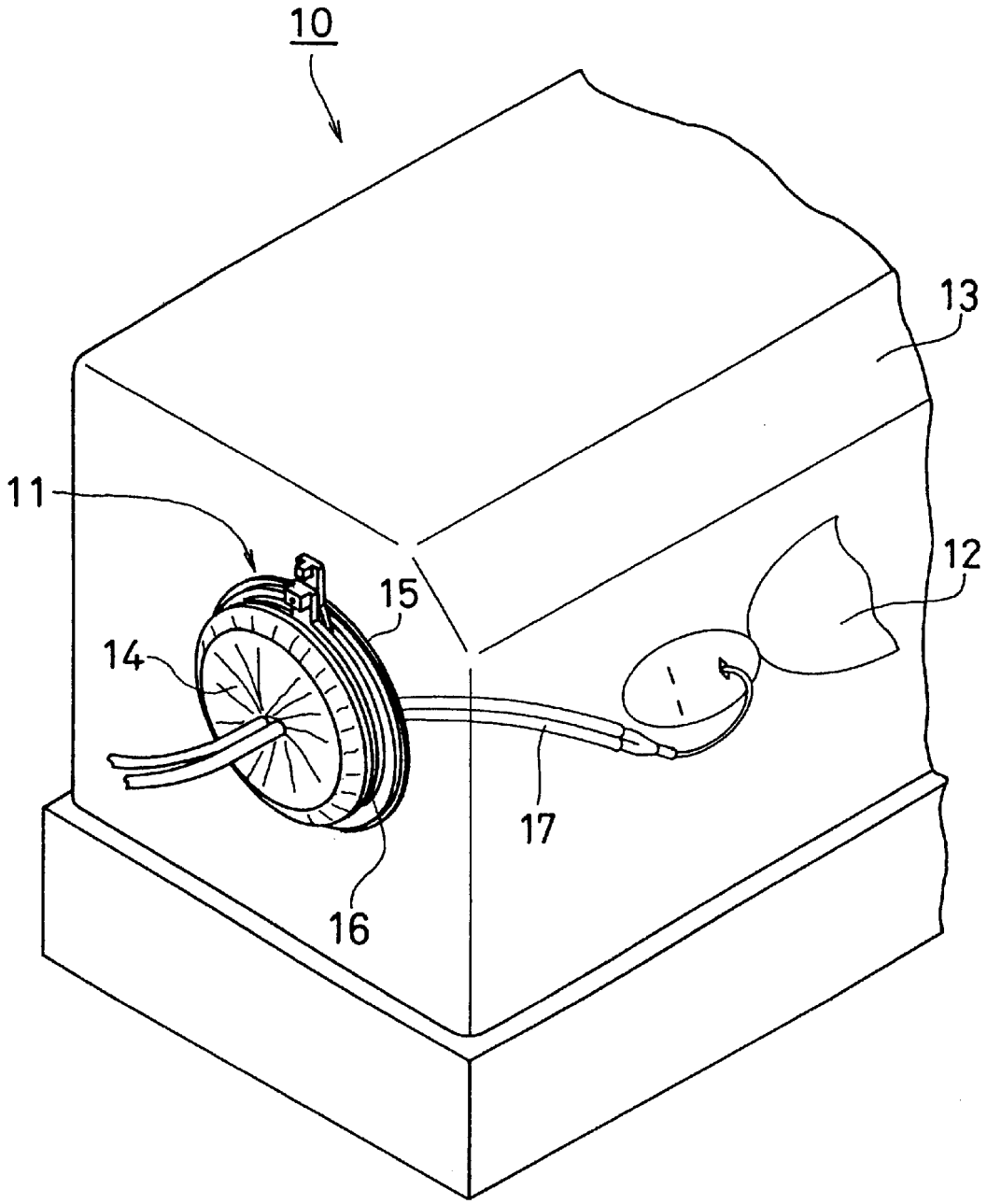
FIG. 2 shows a partial perspective view of the infant incubator in which an access port according to the present invention is mounted on a hood thereof.

FIG. 2 shows a partial perspective view of an infant incubator 10 in which an access port 11 according to the present invention is provided on a hood 13 thereof. For example, an artificial respiration tube 17 is inserted to the mouth of the premature baby 12 through the access port 11.

Figure 1:
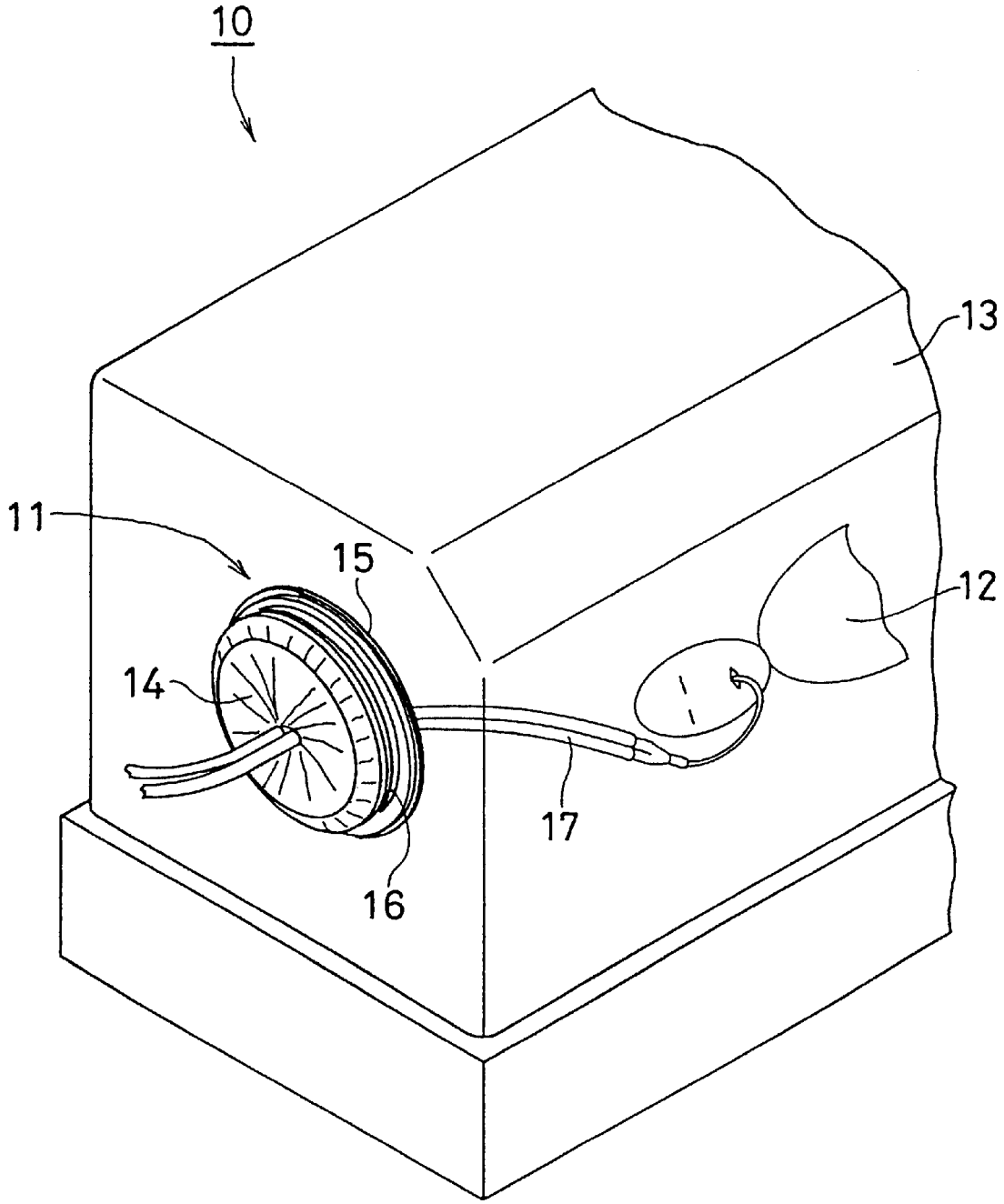
FIG. 1 shows a partial perspective view of a conventional infant incubator.
Figure 3:
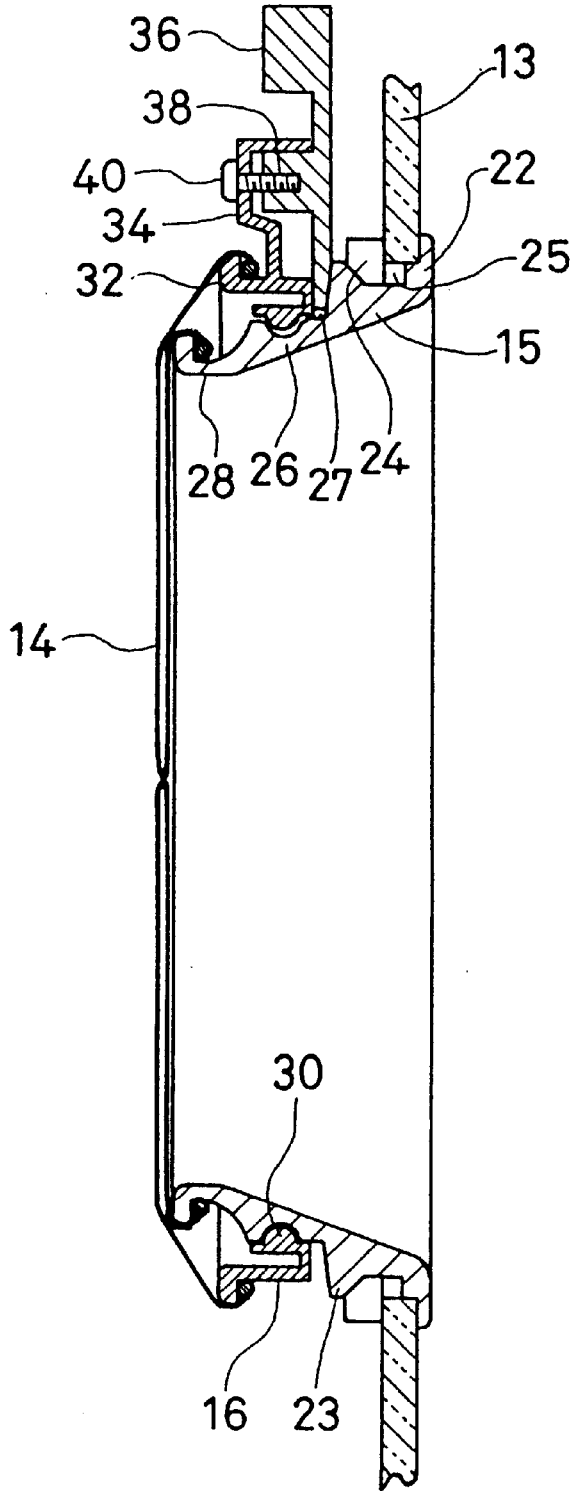
FIG. 3 shows a cross sectional view of the access port of FIG. 2 at its lock position.

FIG. 3 shows a cross sectional view of the access port 11. In FIGS. 2 and 3, similar or same members corresponding to those of FIG. 1 are denoted same numerals, respectively.

In these drawings, the access port 11 is detachably mounted on an opening of a hood 13 of the infant incubator 10. This access port 11 comprises a cylindrical inner frame 15 moulded by a plastic material and detachably mounted on the opening of the hood 13. The inner frame 15 includes a circular flange 22 having a ring portion abutted to the hood 13 adjacent to the opening and a cylindrical portion 23 protruded from the opening when the inner frame 15 is inserted from inside of the hood 13. The flange 22 has then an outer diameter larger than that of the opening. A circular groove 24 is provided on the cylindrical portion 23 integral to the ring portion. An O-ring or snap ring 25 having an outer diameter larger than the diameter of the opening of the hood 13 is fitted between the circular groove 24 and the hood 13 adjacent to the opening to secure the inner frame 15 to the hood 13. Then, the snap ring 25 has an inner diameter smaller than an outer diameter of the circular groove 24 to serve as a retaining ring.

The inner frame 15 includes a circular guide groove 26 provided on a cylindrical surface 27 whose diameter is smaller than that of the cylindrical portion 23, and a circular hook 28 sealingly covered by a rubber contained inner rim of the cylindrical flexible sheet or cloth 14. Then, the flange 22, the cylindrical portion 23 and the hook 28 are integrally moulded in the inner frame 15. The flexible sheet or cloth 14 is sealingly finely woven or coated by sealing additives to provide its airproof.

The outer frame 16 has a ring configuration moulded by a plastic material and a circular channel groove opened at front side is provided and extending toward its axis direction to define outer and inner cylindrical surfaces.

A circular projection 30 is integrally provided on the inner cylindrical surface of the outer frame 16 to slidably engaged on the guide groove 26. The outer frame 16 is snapped to the concentric inner frame 15 so that the circular projection 30 is loosely engaged to the guide groove 26 to smoothly carry or rotate the outer frame 16. A gap is provided between the back of the outer frame 16 and the cylindrical portion 23 to partially expose the cylindrical surface 27.

The outer frame 16 includes a circular hook 32 integral to the outer cylindrical surface thereof and sealingly covered by a rubber contained outer rim of the cylindrical flexible sheet 14 after being folded at about half portion in length. A knob 34 is integrally provided on the outer cylindrical surface of the outer frame 16 to allow the manual rotation of the outer frame 16. A stopper 36 moulded by a plastic material is pivotally supported on the integral knob 34 to enable the rotation of the outer frame 16 or disable the rotation thereof by the increase of the friction between the inner and outer frames 15 and 16.

Figure 4A:
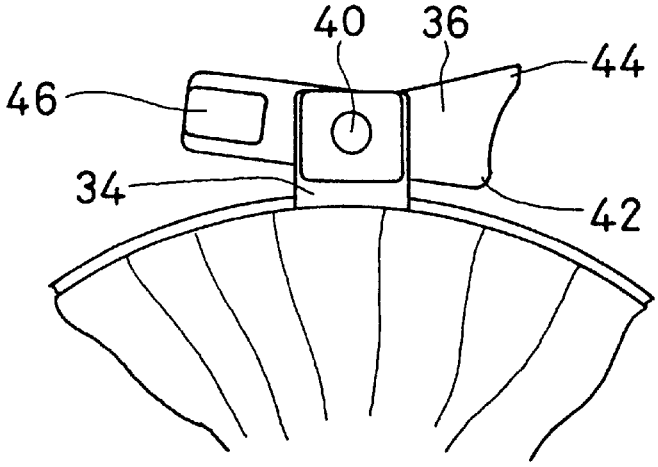
FIG. 4*a* shows a partial front view of the access port of FIG. 2 at its release position.
Figure 4B:
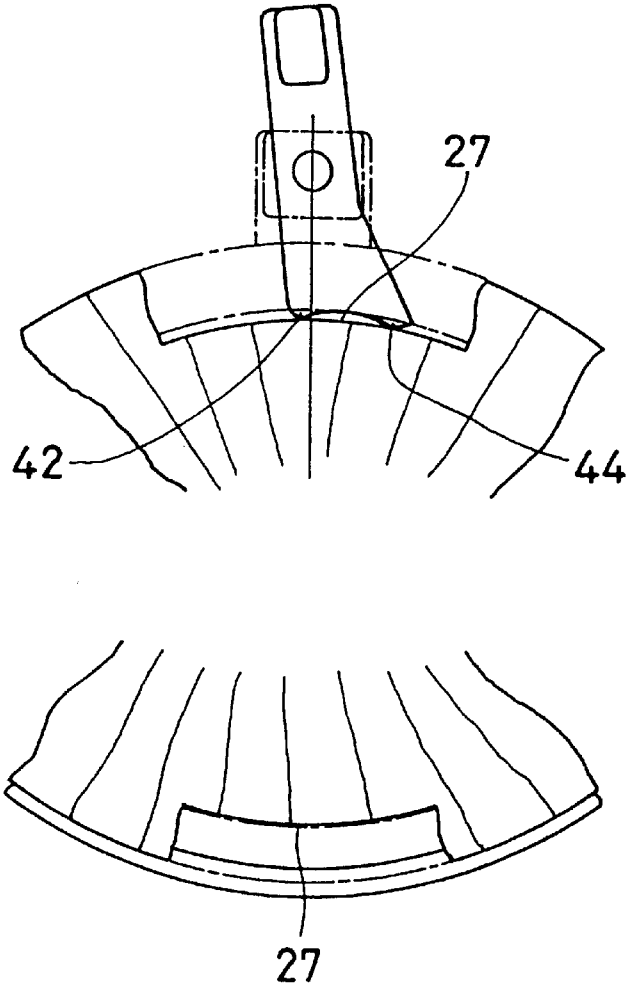
FIG. 4*b* shows a partial front view of the access port of FIG. 3.

FIGS. 4*a* and 4*b* show a partial front view of the access port 11 for describing the action of the stopper 36 in detail. The stopper 36 has a lever configuration and includes a central hole 38 (FIG. 3) tapped by a tapping screw 40, two corners 42 and 44 each provided on one side of the lever, and another knob 46 provided on another side thereof to be manually pivoted. The corners 42 and 44 have a thickness smaller than the gap between the outer frame 16 and the cylindrical portion 23. The first corner 42 is abutted or pressed to the cylindrical surface 27 of the inner frame 15 upon pivoting the stopper 36 adjacent to its dead point between an axis of the hole 38 or screw 40 and coaxes of the frames 15 and 16. The second corner 44 is pressed to the cylindrical surface 27 to limit the rotation thereof over the dead point.

The stopper 36 pivots from the release position as shown in FIG. 4*a* to the lock position as shown in FIG. 4*b* in which the outer frame 16 is held or stopped against the inner frame 15 at the arbitral position. The stopper 36 is so constructed that its lock position is held or latched without another mechanism. Then, the lengths of two corners 42 and 44 from the axis of the hole 38 or screw 40 are determined longer than the length between the axis of the hole 38 and the cylindrical surface 27 of the inner frame 15 under the release position.

Therefore, when the stopper 36 is rotated or pivoted in a clockwise direction, the first corner 42 is initially contacted to the cylindrical surface 27 to generate a first friction force on the opposite or bottom side of mainly the guide groove 26 against the projection 30.

When the stopper 36 is further pivoted in the clockwise direction to its dead point, the first corner 42 is pressed to the cylindrical surface 27 to generate a maximum friction force on the bottom side of the guide groove 26 against the projection 30.

When the stopper 36 is furthermore pivoted in the clockwise direction passing through the dead point, the first corner 42 as well as the second corner 44 is pressed to the cylindrical surface 27 as shown in FIG. 4*b* to generate a second friction force slightly lighter than the maximum friction force on the bottom side of the guide groove 26 against the projection 30, and the outer frame 16 is held on the inner frame 15 in situ.

Therefore, the length of the corner 42 from an axis of the hole 38 is determined slightly longer than the distance between an axis of the outer frame 16 and the hole axis of the knob 34 subtracted by a radius of the cylinder surface 27 and by an offset or tolerance of frames 15 and 16. The length of the corner 44 from an axis of the hole 38 is also determined slightly longer than or equal to that of the corner 42.

Accordingly, when the respiration tube 17 is inserted into the infant incubator 10, the outer frame 16 is then rotated in the clockwise direction to close the flexible sheet 14, and the stopper 36 is pivoted in the clockwise direction to the lock position, the flexible sheet does not opened because the outer frame 16 is not rotated in an anti-clockwise direction even if the self-weight of the respiration tube 17 or the outer force by the movement thereof is applied to the flexible sheet 14. Then, the access port 11 can be substantially sealed while entering the respiration tube 17.

In another embodiment, a plurality of radial slits may be provided with the circular projection 30 integral to the inner cylindrical surface of the outer frame 16 to define individually deformed projection pieces to easily snap the outer frame 16 into the inner frame 15.

The flexible sheet 14 may be provided in a cylindrical configuration by the nylon woven cloth or nonwoven cloth having flexibility, and rubber rings are stitched in the end portions thereof. Therefore, the flexible sheet 14 can be sealingly mounted to the hooks of the inner and outer frames 15 and 16, and easily removed therefrom. On each hooks 28 and 33, additional cap rings may be applied to tightly seal their end portions. The hook 28 of the inner frame 15 may be protruded from the hook 32 of the outer frame 16 to mount or unmount the flexible sheet 14 under the condition that the inner frame 15 is assembled to the outer frame 16.

In the above embodiment, the stopper 36 having an axis parallel to the coaxes of the frames 15 and 16 is described. A modification among others may be made with a stopper having an axis perpendicular to the coaxes of the frames 15 and 16. This stopper having a channel configuration has a central hole pivotally supported between two uprights integral to the knob 34 of the outer frame 16 through a shaft perpendicular to the coaxes of frames 15 and 16. The stopper includes a back teeth meshed with a gear on the cylindrical surface 27 and a front button manually pushed to release its lock condition against a spring between the button and the knob 34. When the nurse's hand is disengaged from the access port 11, it is not forget the lock operation because the stopper is always meshed with the gear due to the biasing of the spring. Alternatively, the stopper may include a reciprocation member along the radial direction of the frames movably supported by the knob and meshed with the gear.

The stopper may be a ratchet mechanism comprising a plurality of ratchet tooth provided on the cylindrical surface of the inner frame and a pawl pivotally supported on the knob of the outer frame to allow the outer frame to be rotated in the clockwise direction. Also the ratchet pawl is biased to engage the ratchet teeth and manually release it.

The outer frame 16 may be movably supported on the inner frame 15 along the axis thereof as well as its rotation. In this case, the circular projection 30 of the outer frame 16 engaged on the guide groove 26 is moved back by backwardly pushing the outer frame 16 to fit a conical surface of the inner frame 15 having slightly increased diameters and successively integral to the groove 26 to increase the friction therebetween. Also, a knurl treatment is applied on the conical surface. Alternatively, a ring gear is provided with the circular projection 30 of the outer frame 16 to be rotated on the smooth guide groove 26 or to be meshed with a geared cylindrical surface upon backwardly pushing the outer frame 16.

The access port 11 according to the present invention is not opened by the self-weight or movement of the respiration tube 17 or cable because the outer frame is rotated in the clockwise direction to squeeze or close the flexible sheet 14 and then the stopper is rotated in the clockwise direction or moved to the lock position. Then, the airproof in the infant incubator 10 is substantially maintained after the respiration tube 17 is inserted into the infant incubator 10 through the access port 11.

As the stopper is provided on the outer frame or the knob thereof, the operator easily recognizes it upon rotating the outer frame to prevent the latch of the stopper from forgetting.

As the stopper on the outer frame is pressed at two point to the inner frame, no additional latch member is needed with a simple construction to prevent the rotation of the outer frame.

Figure 5:
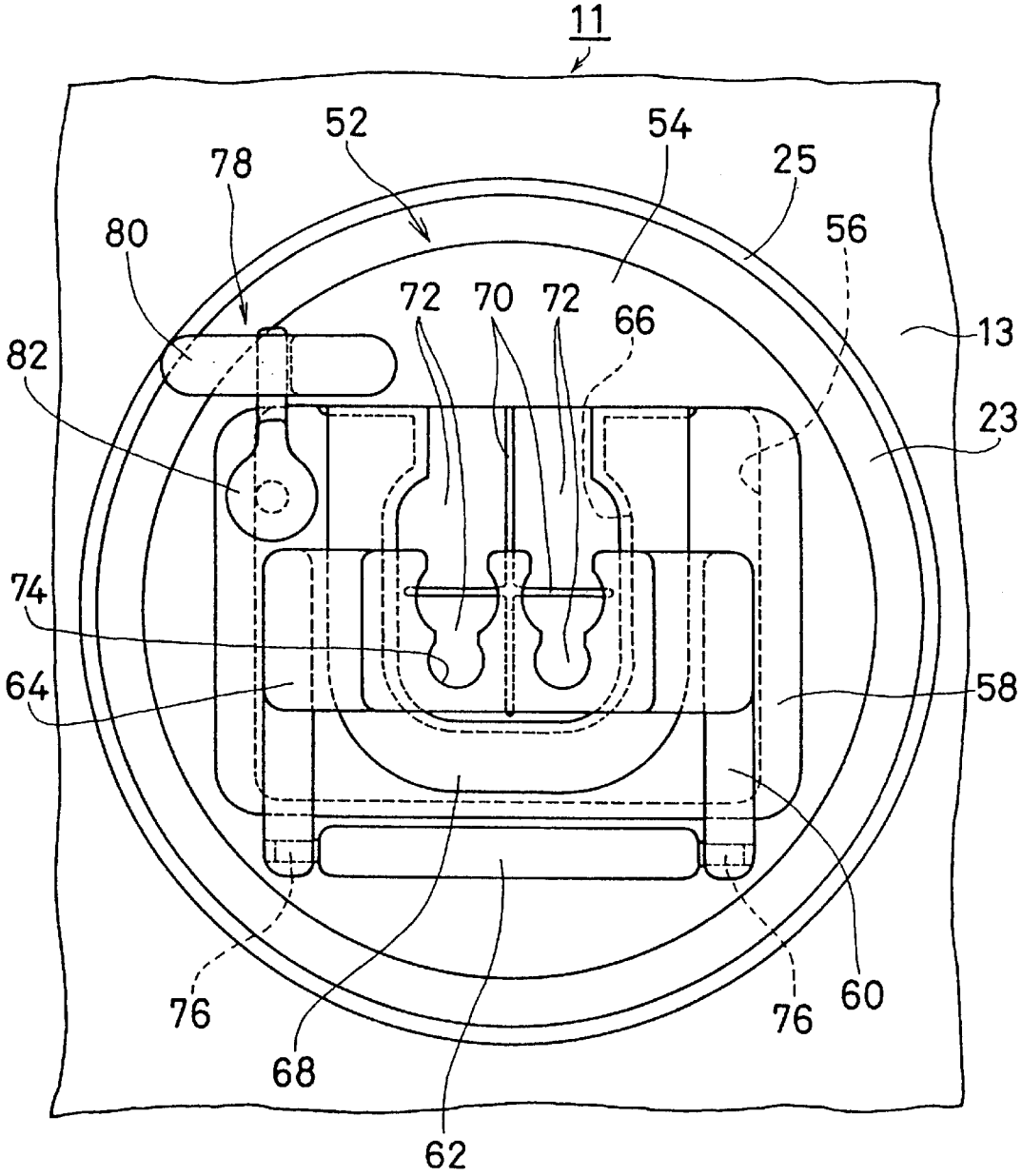
FIG. 5 shows a front view of a second embodiment of the access port according to the present invention.

FIG. 5 shows a second embodiment of the access port 11 detachably mounted to an opening of the hood 13. This hood 13 is used in several medical vessels, in this case, a transparent partition wall of the infant incubator 10.

Figure 6:
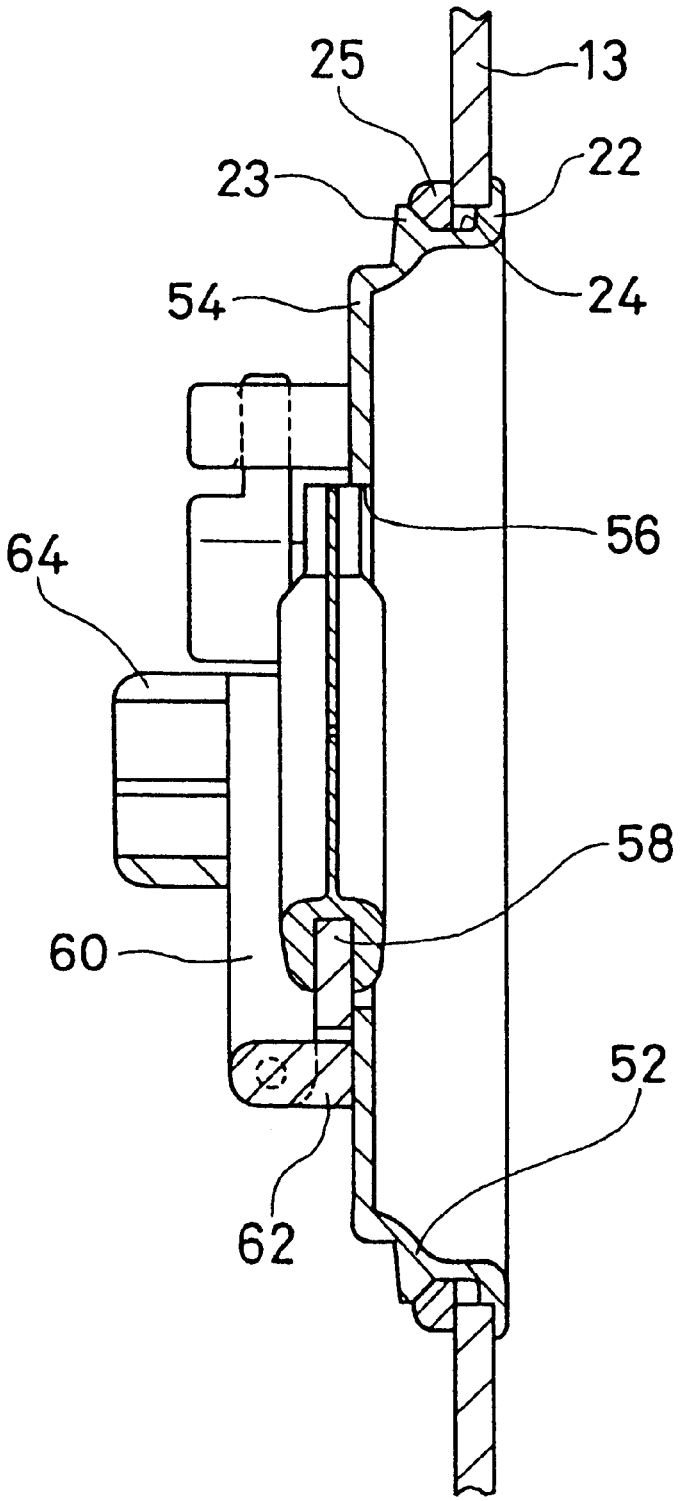
FIG. 6 shows a side view of the access port taken in A—A line of FIG. 5.

FIG. 6 shows a cross sectional view of the access port 11 taken in line A—A of FIG. 5. In FIGS. 5 and 6, similar or same members corresponding to those of FIGS. 1 to 4 are denoted same numerals, respectively.

In FIGS. 5 and 6, the access port 11 comprises a cylindrical frame 52 moulded by a plastic material and detachably mounted on an opening of a hood 13 of the infant incubator 10. The frame 52 includes a circular flange 22 having a ring portion abutted to the hood 13 adjacent to the opening and a cylindrical portion 23 protruded from the opening when the frame 52 is inserted from inside of the hood 13. The flange 22 has then an outer diameter larger than that of the opening. A circular groove 24 is provided on the cylindrical portion 23 integral to the ring portion. An O-ring or snap ring 25 made of a silicon rubber and having an outer diameter larger than the diameter of the opening of the hood 13 is fitted between the circular groove 24 and the hood 13 adjacent to the opening to secure the frame 52 to the hood 13. Then, the spacer ring 25 has an inner diameter smaller than an outer diameter of the circular groove 24 to serve as a retaining ring.

The mounting structure of the frame 52 to the hoof 13 is similar to the conventional one. Therefore, the present access port 11 can be easily substituted with the conventional access port if the size or dimension of the flange is identical.

A base plate 54 is provided or integral to the cylindrical portion 23 of the frame 52. A rectangular opening 56 is centrally provided on the base plate 54 to manually access or handle the respiration tube 17. This opening 56 is closed or opened by a horseshoe plate 58 moulded by a plastic material. The horseshoe plate 58 is pivotally supported through two vertical members 60 by a horizontal member 62 projected from the base plate 54. Then, the vertical members 60 are secured by adhesives to the horseshoe plate 58 at its back side and to a holding plate 64 at its front side, respectively.

The horseshoe plate 58 has a rounded rectangular outside and an upwardly opened inside 66 which receives a shield rubber plate 68 to seal an area of the inside 66. The shield rubber plate 68 has a crossed slit 70 to provide a plurality of individually moved resilient pieces 72. The artificial respiration tube 17 can be passed to the infant incubator 10 through the slit 70 with a tolerable leak level even if the horseshoe plate 58 is closed the opening 56. The holding plate 64 has a set of two grooves 74 to hold the respiration tube 17.

The vertical members 60 carrying the horseshoe plate 58 and the holding plate 64 are pivotally supported to the horizontal member 62 positioned under the opening 56 through a pair of shafts 76. The horseshoe plate 58 is locked or held at the closed position of the opening 56 by a lock mechanism 78. The lock mechanism 78 includes an L-shaped or angle member 80 secured to the base plate 54 and a lock lever 82 pivotally mounted on the horseshoe plate 58. A free end of the lock lever 82 is latched to a space provided between the angle member 80 and the base plate 54 upon closing the opening 56.

The horseshoe plate 58 is pivotally supported at the lower portion thereof as shown in this embodiment. Then, as the horseshoe plate 58 is disposed under the opening 56 by self-weight when open the opening 56, the horseshoe plate 58 does not interfere the manual access through the opening 56.

Two grooves 74 are provided in the holding plate 64 to hold exhalation and inhalation tubes 17 for the artificial respirator. Each groove 74 has two opened circles each having a different radius to hold two types of the respiration tubes 17. Then, the groove 74 has the upper inner width wider than the inner width. In this embodiment, the groove 74 has a gourd configuration viewed from the front.

The shield plate 68 made of the silicon rubber includes a thick peripheral portion attached to a rim of the upwardly opened inside 66 of the horseshoe plate 58 and a thin inner area in which the crossed slit 70 (a lateral slit 70 is shown in FIG. 6) having a substantially zero width or gap is provided to define the plurality oh the resilient pieces 72.

In the crossed slit 70 of the horseshoe plate 68, vertical slit 70 (see FIG. 5) is upwardly opened and extended from its upper rim to its lower side of the thin area to receive the respiration tube 17 from the upper rim to the crossed portion of the slit 70 among the plurality of individually moved resilient pieces 72. Then, when the respiration tube 17 is inserted to the infant incubator 10 through the opening 56 and then the opening 56 is closed by the horseshoe plate 58, the portion of the respiration tube 17 is easily positioned to the plurality of individually moved resilient pieces 72 through the vertical slit 70. Therefore, the lateral slit 70 is aligned with a virtual horizontal diameter of the upper circular groove 74.

Figure 7:
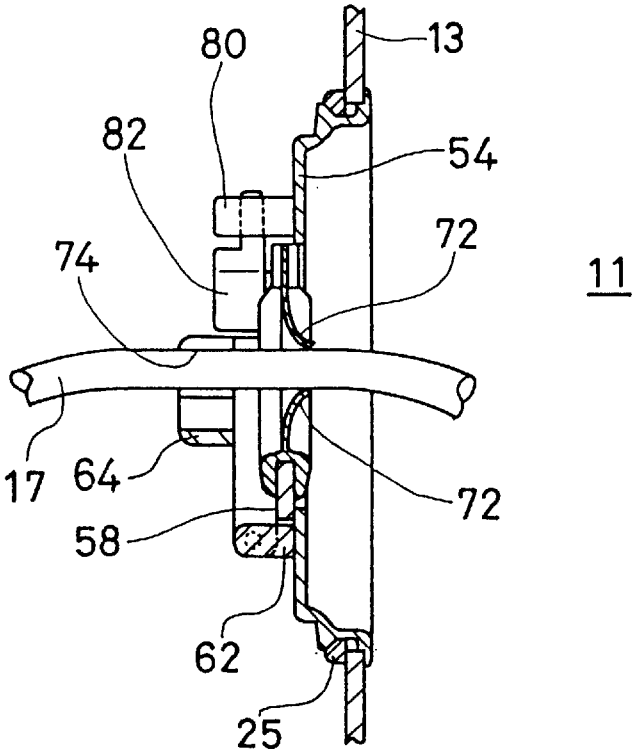
FIGS. 7 and 8 are cross sectional views of the access port of FIG. 5 at open and close positions, respectively.
Figure 8:
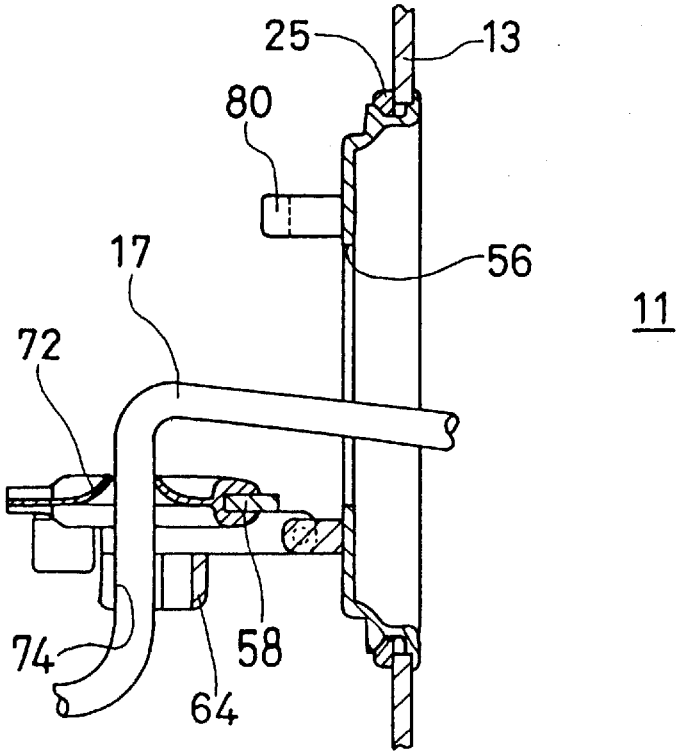

FIGS. 7 and 8 are sectional views similar to FIG. 6, showing a condition in which the respiration tube 17 is inserted to the access port 11. FIG. 7 shows a condition in which the opening 56 is closed by the horseshoe plate 58 and FIG. 8 shows a condition in which the opening 56 is opened.

As shown in FIG. 7, the respiration tube 17 passing through among the plurality of resilient pieces 72 is firmly held by the groove 74 of the holding plate 64 of the horseshoe plate 58. Then, even if a force is applied to the one side of the respiration tube 17 before the holding plate 64, another side of the respiration tube 17 is not affected by such a force.

As shown in FIG. 8, the respiration tube 17 is firmly held by the groove 74 of the holding plate 64, even if the opening 56 is opened by pivoting the horseshoe plate 58. Then, even if the nurse is manually operated through the opening 56, the respiration tube 17 is not removed from the holding plate 64, and the respiration tube 17 does not interfere the work of the nurse.

While the embodiments of the access ports according to the present invention are described as mentioned above, any modification to the construction of the access port can be made. For example, the lock mechanism 78 may include an L-shaped or angle lock lever pivotally sealingly supported on the base plate 54 and having its free end for gripping the horseshoe plate 58 associated with the base plate 54 upon pivoting to the lock position.

The holding plate 64 may include secure means for securing the respiration tube in the groove after receiving the tube by the groove to completely hold the tube. The securing means may be mechanically synchronized with the lock mechanism.

A second lateral slit 70 may be provided to be aligned with a virtual horizontal diameter of the lower circular groove 74.

A plurality of the resilient pieces may be provided with the thin shield plate 68 having an upwardly opened vertical slit along a Y-axis, two lateral silts each successively connected to the vertical slit and extending along an X-axis between two points including virtual Z-axes of the upper or lower circular grooves 74, and four sets of radial slits extending from the four points including the virtual Z-axes of the upper and lower circular grooves 74. The lengths of the radial slits are substantially identical to diameters of upper and lower circular grooves, respectively.

According to this embodiment of the invention, the respiration tubes can be inserted, firmly held with the negligible leakage of the controlled air by providing the crossed slit or additional radial slits aligned with those of grooves of the holding plate.

As two types of two groove sets are prepared, plural members are efficiently inserted to the medical vessel with one access port.

The foregoing disclosure and description of the invention are illustrative and explanatory thereof, various change in the size, shape materials, components, as well as in the details of the illustrated construction and method of operation may be made without departing from the spirit of the invention.

What is claimed is:

1. An infant incubator including a transparent hood, an opening defined by said hood, and an access port mounted in said opening permitting insertion of a member into the incubator, said port being formed by:

a frame having an opening;

a horseshoe plate pivotally supported on the frame to open or close said frame opening;

a lock mechanism for locking said horseshoe plate in a closed position;

an inner side provided on the horseshoe plate;

a resilient member mounted to said horseshoe plate on said inner side;

a slit defined by the resilient member for insertion of a member, and a holding means provided on the horseshoe plate to hold a member inserted through said slit when said horseshoe plate is in said closed position.

2. An incubator according to claim 1, characterized in that said holding means comprises at least one groove aligned with the horseshoe plate adjacent said inner side.

3. An incubator according to claim 2 including means defined by said groove for gripping said member whereby said member is firmly held within said groove whereby said member is held by said holding means in the open or closed positions of said horseshoe plate.

* * * * *